United States Patent [19]

Beagley

[11] Patent Number: 4,467,796

[45] Date of Patent: Aug. 28, 1984

[54] EMERGENCY BREATHING AIR SUPPLY SYSTEM AND APPARATUS

[76] Inventor: Arthur E. Beagley, 5920 Boulder Hwy., Las Vegas, Nev. 89122

[21] Appl. No.: 326,562

[22] Filed: Dec. 2, 1981

[51] Int. Cl.[3] ..... A62B 7/00

[52] U.S. Cl. ..... 128/202.13; 128/205.25; 128/200.24

[58] Field of Search ..... 128/200.24, 201.22–201.29, 128/202.13, 202.19, 204.18, 205.25, 206.27, 206.28, 207.12, 207.13, 202.27, 205.24, 205.26, 205.28, 206.15, 206.12, 206.21; 98/1.5 R, 2, 33 R; 244/118.5

[56] References Cited

U.S. PATENT DOCUMENTS

| | | | |
|---|---|---|---|
| 472,163 | 4/1892 | Duffy | 98/33 R |
| 1,005,196 | 10/1911 | Gold et al. | 128/202.13 |
| 2,299,793 | 10/1942 | Cannaday et al. | 128/202.13 |
| 3,073,301 | 1/1963 | Hay et al. | 128/205.25 |
| 4,165,738 | 8/1979 | Graves et al. | 128/202.13 |
| 4,331,139 | 5/1982 | Popa | 128/206.12 |
| 4,373,522 | 2/1983 | Zien | 128/206.12 |

*Primary Examiner*—Henry J. Recla

*Attorney, Agent, or Firm*—Seiler, Quirk & Tratos

[57] ABSTRACT

Fresh air is circulated to rooms of a highrise building during an emergency, such as a fire, from a source of compressed air located outside the building. Air is passed through insulated pipes to breathing units located in the rooms. Each breathing unit contains a plurality of extendable masks for placing over the user's nose and mouth, precluding inhalation of smoke and fumes in the room. A preferred valving arrangement permits fresh air to be drawn from the pressurized air source or from outside the building immediately adjacent the room.

5 Claims, 8 Drawing Figures

FIGURE 1.
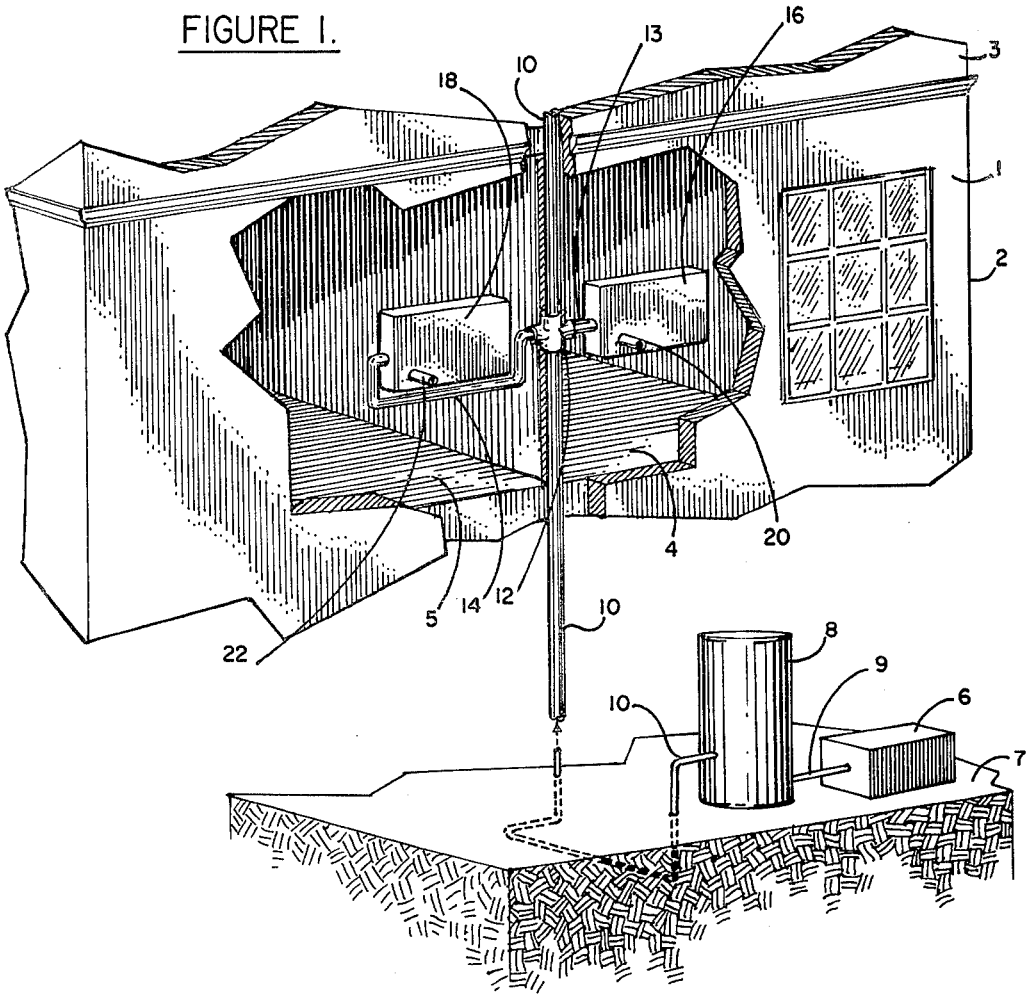
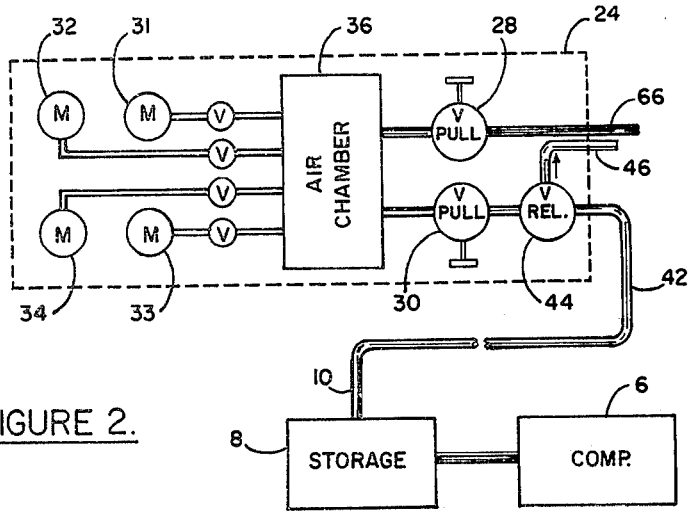
FIGURE 2.

FIGURE 5.
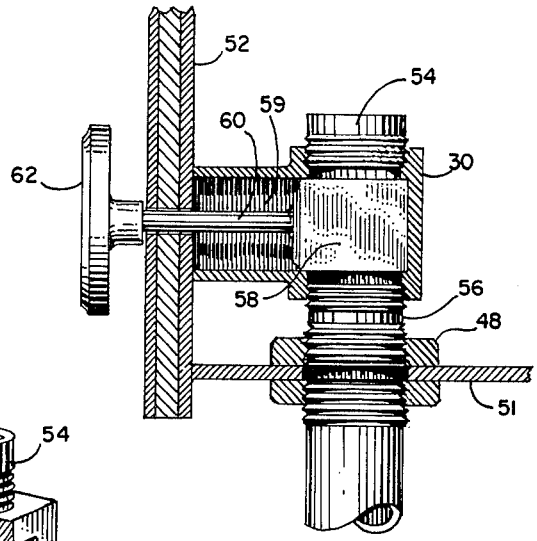
FIGURE 6.
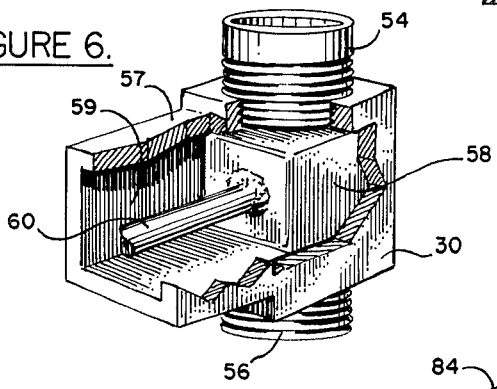
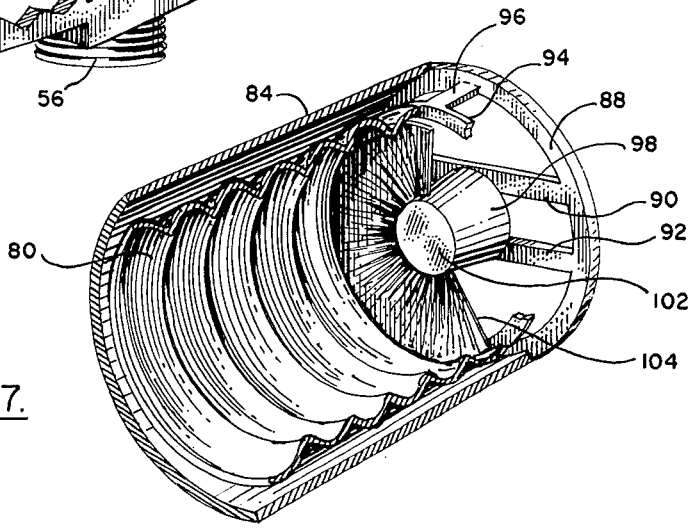
FIGURE 7.
FIGURE 8.
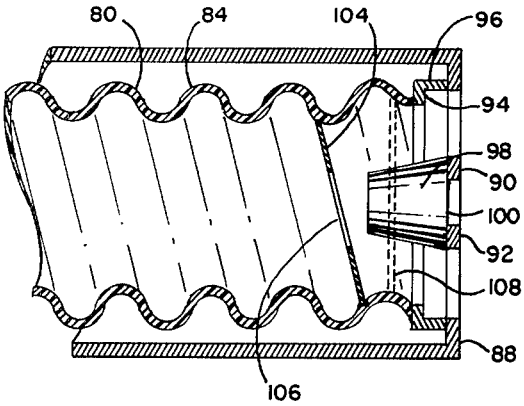

EMERGENCY BREATHING AIR SUPPLY SYSTEM AND APPARATUS

BACKGROUND OF THE INVENTION

This invention relates to a method and apparatus for circulating breathable fresh air to occupants of multiple story buildings in emergency situations. More particularly, it relates to a system for providing fresh air during a fire to rooms from air sources located outside the building, one of which may be a source of compressed air, through distribution systems including breathing masks contained in the rooms.

Problems associated with the safety of occupants of multiple story, and particularly high-rise, buildings have been of substantial concern ever since multiple story buildings have existed. In most municipalities, fire safety codes have been continually updated to require multiple story buildings to have fire alarms, emergency exits, internal fire-resistant barriers, smoke detectors, and the like. Nevertheless, in recent years high-rise fires have continued to take a large toll of human lives.

It is known that the substantial majority of loss of life or serious injury in a high rise fire is caused not by direct contact with the fire or heat, but by suffocation from inhalation of smoke and other noxious combustion products which travel rapidly through the building. Combustible materials within a building, particularly synthetic materials used to fabricate carpeting, draperies, and upholstery, may burn readily at elevated temperatures and may also produce poisonious fumes. Smoke and fumes travel rapidly throughout hallways, stairways, elevator shafts, and internal ventilating systems and may also travel along the exterior of the building, reentering through doorways and broken windows. As a result, a fire which is contained in a relatively small section of the building may cause serious injury and damage in a large portion of the building by travel of smoke and fumes throughout the building.

Various attempts have been made in the past to control the flow of smoke in a high-rise building in the event of fire. For example, in Munk et al, U.S. Pat. No. 4,058,253, signals from smoke detection devices located throughout a building are used to control dampers within the air circulation system of the building to create an air flow from non-smoke areas of the building toward the smoke area. This system prevents smoke from being circulated through the air circulating system and forces the smoke out of the building. A similar smoke clearing system is disclosed in Moss, U.S. Pat. No. 4,068,568. Under normal operating conditions, air flows continuously from rooms in the building to common areas of the building through cracks in the doorways and the like, thereby ensuring that if a fire occurs in one of the rooms, smoke will be carried into a common area where it will be detected by a smoke detector. When smoke is detected in a common area, the conditions are reversed so that pressure in the common area is maintained above that in the rooms, thereby creating a flow of air from the common area to the rooms, isolating the smoke in the room and preventing further smoke from entering a common area. Other forced air ventilating system for circulating fresh air to a building in the event of emergency are shown in Geiger et al, U.S. Pat. No. 2,014,840, and Geiger et al, U.S. Pat. No. 2,679,795. Various types of forced air distribution systems to rooms within buildings are of course known, such as those shown in Burghartz, U.S. Pat. No. 3,780,638, Weis, U.S. Pat. No. 493,321, and Cowderoy-Dale, U.S. Pat. No. 2,188,566.

It is also of course well known to provide breathing apparatus including a face mask or other device for providing air or oxygen to the nose and mouth area of a user under certain circumstances. For example, Leonard, U.S. Pat. No. 879,391, discloses a breathing bag and mask to supply outdoor air to a tuberculosis patient located indoors. Miller et al, U.S. Pat. No. 2,931,355, discloses a system for automatically providing a breathing mask to an airline passenger whenever the cabin pressure experiences a sudden drop.

The present invention provides a method of supplying fresh air to rooms in a multiple story building during a fire. Air may be supplied selectively from either the exterior of the building immediately adjacent the room in which the breathing device is located, or from a central system of air forced into an internal conduit system which supplies the breathing unit in the room. Each room unit is supplied with a plurality of breathing masks which extend from the unit for placement over the nose and/or mouth area of the user. When not in use, the masks retract back into the unit to provide a compact, unobtrusive wall-mounted device. By operating a pair of simple pull valves, the user may select an appropriate air source.

Accordingly, it is an object of the invention to provide a system for supplying fresh, breathable air to occupants of rooms in a multiple story building during an emergency. It is a further object of the invention to provide such occupants with alternate sources of breathable air which may be selected by the occupant to ensure that breathable air is available. It is a further object to provide wall-mounted apparatus containing an air supply chamber which communicates with external sources of fresh air and which also contains a plurality of breathing masks which may be extended from the unit for use during an emergency. These and other objects of the invention will be clear from the following description of a preferred embodiment thereof.

BRIEF SUMMARY OF THE INVENTION

A system for supplying air to occupants of a multiple story building during an emergency comprises an air source under pressure located external to the building, a conduit for conducting air from said source to rooms in the building, and air distribution means in the rooms having a plurality of face engaging means for directing air flow from the conduit to the nose and mouth area of the user. Valve means are provided for controlling the flow of air from the conduit to the face engaging means. In a preferred embodiment, a second source of fresh air is provided to communicate with the face engaging means. Apparatus is also provided for supplying a flow of breathable air to the nose and mouth area of the user in the room comprising an air supply chamber, a first conduit for supplying air under pressure to the chamber, a second conduit for supplying air from the exterior of the building to the chamber, first and second valve means for controlling the flow of air in each conduit to the chamber, and a plurality of face engaging means for conducting air from the chamber to the nose and mouth area of the user's face.

BRIEF DESCRIPTION OF THE DRAWINGS

The invention is best understood with reference to the drawings, in which:

FIG. 1 represents a partially schematic diagram of an air supply system of the invention, FIG. 2 represents a totally schematic view of the system of the invention, FIG. 5 shows a side section view of a pull valve used in the air distribution unit, FIG. 6 shows a cutaway perspective view of the pull valve of FIG. 5, FIG. 7 shows a section perspective view of a portion of a mask conduit, and FIG. 8 shows a side view of the mask conduit shown in FIG. 7.

DETAILED DESCRIPTION OF A PREFERRED EMBODIMENT

Figure 3:
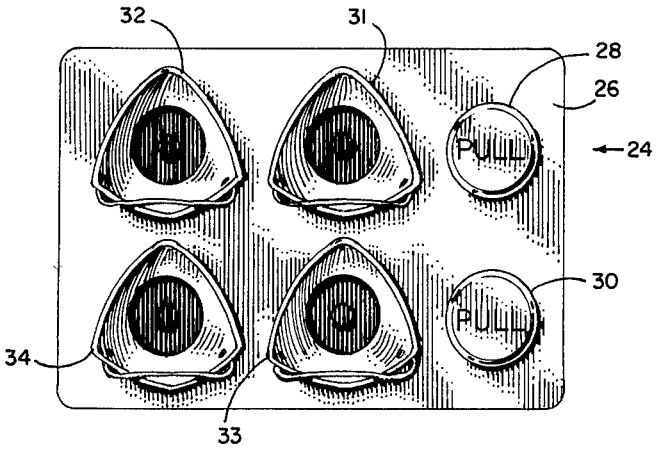
FIG. 3 shows a front view of the air supply panel located within a room.

Referring first to FIG. 1, a multiple story building 1 is shown in partial view with story 3 shown immediately above story 2. The system of the invention is particularly useful in buildings with a large number of stories, since the problem of smoke transmission in the event of a fire is particularly acute in high-rise type buildings. Also shown in FIG. 1 are adjacent rooms 4 and 5 in which are mounted breathing units 16 and 18 of the invention. The breathing units are mounted on the inside of exterior walls of the building such that conduits 20 and 22 may extend directly externally of the building to provide one source of fresh air to the breathing units. The units are discussed in detail subsequently herein.

Air is supplied to the breathing units from a conventional air compressor or blower 6 (shown in a housing) located on a portion of ground 7 exterior of the building. Compressed air is stored in storage tank 8 located proximate to the compressor and communicating therewith through pipe 9. The size of the compressor or blower, and the size and pressure of air stored in the storage tank (if any) will be determined primarily by the number of rooms which each source of air under pressure is required to serve. Multiple sources of pressurized air may of course be necessary in some cases. Upon demand, air passes from the storage tank through appropriate conduit 10 to the breathing devices in the rooms, shown in FIG. 1 as attached to conduit 10 through a tee 12 and short lengths of piping 13 and 14. The various valves, pressure regulators, pressure relief valves, connectors, and the like will vary depending upon the needs of each system and are not shown in the drawings; these auxiliary features will however be obvious to those skilled in the art.

FIG. 2 depicts a schematic diagram of the system of the invention, with particular attention to the room-located breathing units. Air passes from compressor 6 and storage 8 through conduit 10 to breathing unit 24 located in a room. The particular breathing unit shown in FIG. 2 is supplied by air through two sources; air is supplied immediately from the exterior of the building through conduit 66, and air from the pressurized source is supplied through conduit 42 which communicates with conduit 10 from the storage tank. Breathing unit 24 carries four breathing masks 31, 32, 33, and 34 which are supplied with fresh air from air chamber 36 located on the interior of the unit. Each breathing mask is supplied with a small plug valve, designated in FIG. 2 by the letter "V", which actuates automatically when the mask is pulled outwardly from the unit. Air enters air chamber 36 from two sources; fresh air from immediately outside the room on the exterior of the building is accessible through conduit 66, while air from the pressurized air supply source is available through line 42.

Pressurized air passes through pressure relief valve 44 and pull valve 30 into the air chamber. The pressure relief valve, which may also contain a pressure regulator to ensure that air pressure is supplied at no more than e.g. 1–2 p.s.i.g. is preferably a conventional automatically resettable spring-loaded device which is vented through line 46 to the exterior of the building. If desired, the pressure relief valve vent line can be vented through line 66 which also communicates with the exterior of the building; this arrangement is shown in FIG. 1. In an emergency, the user may select to have air from exterior of the building or from the pressurized air source supplied by the air chamber by actuating pull valves 28 and 30, respectively. Under normal operating conditions, both pull valves will be closed and the masks will be set in place in the wall units. In an emergency, the masks are extended away from the unit and one of the pull valves is opened, thereby providing fresh air to the air chamber and consequently to the user.

FIG. 3 shows a front view of a breathing unit as mounted on a wall. Breathing unit 24 has a face plate 26 which mounts against the wall. Masks 31, 32, 33, and 34 are shown in retracted position. Pull valves 28 and 30 are used to control fresh air flow from outside the building or from the pressurized air supply source, respectively.

Figure 4:
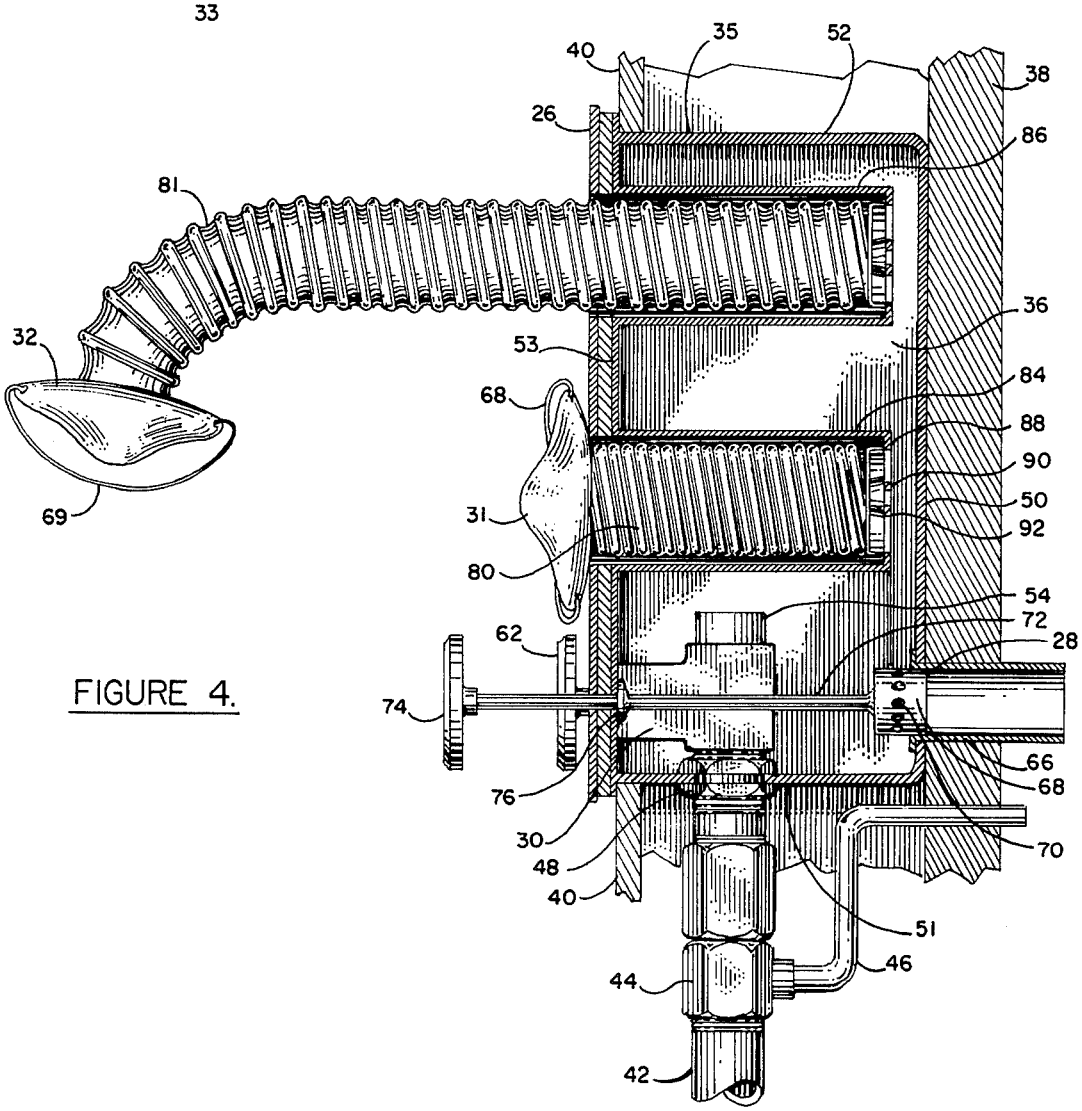
FIG. 4 shows a top section view of a room air distribution unit of the invention.

A more detailed view of a breathing unit of the invention is shown in FIG. 4. The breathing unit is generally defined by a box-like enclosure 35 having a rear wall 50 and side walls 51 and 52. A front chamber wall 53 is located behind the face plate 26. The breathing unit is mounted in a building wall between the interior drywall 40 and the exterior wall of the building 38. Box 35 generally defines and encloses an air supply chamber into which fresh air is supplied from exterior of the building and from a pressurized air source, and from which the fresh air is conducted into the masks.

Fresh air from the exterior of the building enters air supply chamber 36 through a simple pull valve 28 which is mounted in the exterior wall of the building. The valve consists of a valve body which is a short piece of tubing 66 which extends through building wall 38 to the exterior of the building, and a piston member 68 which slides axially between an open and closed position in the valve body. The valve, which is shown in FIG. 4 in the open position, is actuated by pulling handle 74 which is attached to the piston by valve stem 72. Further extension of the handle 74 is precluded by stop collar 76, which abuts the interior of front wall 53 of the breathing unit. The piston portion 68 of the valve has a hollow interior, permitting air flow through a series of circumferentially located bores 70 through the piston wall. When the valve is in the open position, fresh air passes from the exterior of the building through tubing 66 and into chamber 36 through bores 70. When the handle 74 is pushed in, the piston slides into the valve body, thereby precluding air flow through the bores in the piston.

Control of passage of air from the pressurized air source into air chamber 36 is shown in FIGS. 4, 5, and 6. Air from the pressurized air source passes through the tubing 42 and pressure relief valve 44 into the breathing unit. Connecting tubing is fastened to the breathing unit by threaded fitting 48. A second pull valve 30 is mounted on the interior of the breathing unit and controls the supply of pressurized air to the air supply chamber 36 through tubing 54. The valve is shown mounted to threaded fitting 48 through a short threaded pipe fitting 56 (see FIGS. 5 and 6).

Details of construction of pull valve 30 are shown in FIGS. 5 and 6. Valve 30 has a housing 57 which defines a valve chamber 59 having a generally rectangular cross section. A valve plug 58 is mounted on valve stem 60 and fits slideably in the valve chamber. The valve is actuated by pulling valve handle 62, which is mounted on the opposite end of valve stem 60 from the plug, outwardly from the front of the breathing unit. The plug slides into the upper portion of the housing 57, permitting the passage of air through the valve and into air supply chamber 36 through tubing 54. It should be understood that while the valve members shown in FIGS. 4, 5, and 6 are particular types of pull valves, the invention may be constructed with any types of valves. Conventional ball valves, gate valves, or butterfly valves may be used, and may be actuated with a handle that is turned rather than one that is pulled as shown in the drawings.

Masks 31 and 32, carrying elastic straps 68 and 69 for fastening to a user's head, are mounted in the breathing unit in canisters 84 and 86, respectively. The masks are mounted at the end of flexible corrugated tubing members 80 and 81 which serve as conduit means to supply air from the air supply chamber 36 to the mask. In FIG. 4, mask 31 and tubing 80 is shown in the retracted or compressed mode, in which the mask is stored for usage. Mask 32 and tubing 81 are shown in the extended position, in which the mask is prepared for usage.

Details of the mounting of the mask tubing in the canisters is shown in FIGS. 7 and 8. Canister 84 is of generally cylindrical configuration with a partially cut away bottom wall 88. Flexible tubing 80 is fastened to a circular mounting ring 94 which is mounted on a pair of supports 96 which extend between the bottom wall 88 of the canister and the mounting ring 94. An internal diaphragm 104 which mates with a plug 98 mounted on the back canister wall serves as an additional valve means for permitting air to pass from the air supply chamber to the mask. This valve or stop means is actuated automatically when the mask is pulled from the canister. A plug 98 having a frusto-conical shape is mounted on a pair of struts 90 and 92 which traverse the bottom of the canister. Back wall 100 of the plug is permanently fastened, e.g., by adhesive, to the struts. The plug extends inwardly axially along the center line of the canister. The diaphragm member 104 has a centrally located circular aperture 106 and extends radially across the entire cross-section of a rear portion of the corrugated tubing.

When the mask is stored in the canister, or is not fully extended, as shown in FIG. 7, the diaphragm extends over the plug, assuming the position 108 shown in phantom in FIG. 8 and closing air flow from the air supply chamber into the body of the corrugated tubing. When the mask is fully extended, as shown in FIG. 8, the diaphragm 104 automatically pulls away from the plug, permitting air flow through the open bottom of the canister and into the tubing through aperture 106. When the mask is replaced in storage position in the canister, the diaphragm slips over the plug, again closing the flow of air to the mask. The diaphragm and plug are made of a generally rigid rubbery material to permit proper sealing when the mask is in the stored position. This valve means in each mask permits a very simple yet effective method of permitting air passage only through masks which are in fact in use. Again, the particular valve means used in the masks is not a critical feature of the invention, and any conventional means for precluding the passage of air into the masks except when desired may be used.

The particular materials of construction of the unit of the invention are well within the knowledge of those skilled in the art and form no part of the invention. It should be noted however that the conduit 10 which brings air from the pressurized air source and distributes the air throughout the multistory building should be completely fire and heat resistant. A particularly effective pipe construction is a calcium silicate piping having a stainless steel inner sleeve with a plurality of annular tubular voids in the calcium silicate. This pipe is highly temperature and fire resistant and is commercially availabe from Johns-Manville Company.

As will be readily apparent to those skilled in the art, the present invention may be used in many specific forms without departing from its spirit or essential characteristics. The specific embodiments of the invention disclosed herein considered to be illustrative rather than limiting, and the scope of the invention should be measured not by the description thereof but rather only by the following claims.

I claim:

1. Apparatus for providing a flow a breathable air to the nose and mouth area of a user in an emergency which comprises a housing having a front panel, an air supply chamber in said housing, first conduit means for supplying air to said chamber, first valve means for controlling flow of air through the first conduit means to said chamber, a plurality of face-engaging means for distributing air from the chamber to the nose and mouth area of a user's face, and second conduit means for conducting air from the air supply chamber to each of said face engaging means, and a plurality of open ended cylindrical storage means each having one end mounted through said front panel and an opposite end extending into said housing; said second conduit means comprising compressible flexible tubing slidably mounted in said cylindrical storage means and having first and second ends, said first end connected to said face engaging means and said second end permanently attached to the opposite end of said cylindrical storage means, passageway means fluidically communicating the opposite end of said storage means with said air chamber to permit flow of air from the air chamber into the flexible tubing, whereby said flexible tubing is extendable between a compressed stored position within the housing and an operating position extending from said housing.

2. Apparatus as claimed in claim 5 for providing a flow of breathable air to the nose and mouth area of a user in an emergency further comprising second valve means operably connected with said flexible tubing and cylindrical storage means for controlling the flow of air from the air chamber through the flexible conduit, and which is simultaneously actuated when the face-engaging means is removed from the housing.

3. The apparatus of claim 2 wherein the flexible conduit comprises longitudinally compressible tubing.

4. The apparatus of claim 3 wherein the tubing is corrugated tubing.

5. The apparatus of claim 3 also comprising a rigid cylindrical mounting enclosure within the housing for holding said conduit in a compressed position.

* * * * *